United States Patent [19]

Morgan

[11] 4,057,983

[45] Nov. 15, 1977

[54] LOCK FOR SKIS

[76] Inventor: Steven J. Morgan, 4925 SW. 45th, Apt. 2, Portland, Oreg. 97221

[21] Appl. No.: 705,133

[22] Filed: July 14, 1976

[51] Int. Cl.[2] ..... E05B 73/00

[52] U.S. Cl. ..... 70/18; 24/73 SG; 24/248 R; 70/58; 280/11.37 A

[58] Field of Search ..... 70/58, 19, 18, 59, 61, 70/15, 14, 57, 30, 49; 211/60 SK; 280/11.37 A, 11.37 K, 11.37 C, 11.37 E; 224/45 S, 5 Z; 24/73 SG, 81 SK, 248 R, 248 L, 248 BJ, 249 R, 249 CR

[56] References Cited

U.S. PATENT DOCUMENTS

| | | | |
|---|---|---|---|
| 1,292,486 | 1/1919 | Kumler | 70/18 |
| 1,301,498 | 4/1919 | Pohl | 70/18 |
| 2,133,883 | 10/1938 | Aubert | 70/58 |
| 3,511,384 | 5/1970 | Pratt | 211/60 SK |
| 3,643,810 | 2/1972 | Highberger | 70/58 |
| 3,905,214 | 9/1975 | Bell | 70/58 |
| 3,935,977 | 2/1976 | Bonnett | 280/11.37 K |

*Primary Examiner*—Casmir A. Nunberg
*Assistant Examiner*—Kenneth J. Dorner
*Attorney, Agent, or Firm*—Clarence A. O'Brien; Harvey B. Jacobson

[57] ABSTRACT

A lock for skis having a pair of clamp elements each provided with a recess disposed for receiving a ski. The elements are connected together by a hinge so that the elements can pivot relative to one another to and from a position clampingly engaging a pair of skis disposed in the recesses and retain the skis in abutting relationship. Grooves are also provided for clampingly receiving a pair of ski poles in crossed fashion. The elements are secured to one another in the clamping position by a suitable locking device.

14 Claims, 10 Drawing Figures

12
T
10
14
S
16

10
36
34
3
14
18'
26
24
42
38
22
26
20
18
48
46
16
34
36
3

36
18'
18
36

44
40
56
56
58
58
18'
30'
26
36
34

22
30
18
52
32
28
26
56
58
30
36
58
56
42
38
50
54

72'
76
82
80
74
72
78
K

LOCK FOR SKIS

BACKGROUND OF THE INVENTION

1. Field of the Invention

This invention relates generally to a ski lock, and particularly to a lock for releasably retaining a pair of skis and associated ski poles in such a manner as to discourage unauthorized tampering with and removal thereof.

DESCRIPTION OF THE PRIOR ART

Various approaches have been proposed for holding and securing ski equipment such as skis and ski poles so as to prevent removal of the equipment by unauthorized persons. In particular, ski locks have been devised for rigidly gripping a pair of skis and the associated poles. Examples of ski locks previously proposed can be found in U.S. Pat. No. 3,242,704, issued Mar. 29, 1966 to H. J. Barreca; U.S. Pat. No. 3,277,676, issued Oct. 11, 1966 to P. W. Poehlmann et al; U.S. Pat. No. 3,429,152, issued Feb. 25, 1969 to F. J. Whitaker et al; U.S. Pat. No. 3,518, 853, issued July 7, 1970 to A. N. Bolte; U.S. Pat. No. 3,874,202, issued Apr. 1, 1975 to R. H. Effenheim; and U.S. Pat. No. 3,894,414, issued July 15, 1975 to S. R. Peterson.

SUMMARY OF THE INVENTION

It is an object of the present invention to provide a ski lock of light weight yet rugged construction which will permit skis and associated ski poles to be secured to one another and to a post, rail, tree, and the like, in such a manner as to make a bulky package for a would be thief.

It is another object of the present invention to provide a ski lock which permits the resulting package of skis and poles to form a relatively stable unit which can be stood upright in snow, and the like.

It is yet another object of the present invention to provide a ski lock which is adjustable to receive skis of various widths.

These and other objects are achieved according to the present invention by providing a ski lock having: a pair of clamp elements each provided with a recess disposed for receiving a ski; a hinge connected to the clamp elements for pivotally connecting the elements together and permitting relative movement between the elements to and from a clamping position wherein a pair of skis are retained in abutting relationship with respect to one another; and a locking device connected to the clamp elements for retaining the elements in an abutting, each recess opposed to the other, ski holding relationship which forms the clamping position.

An advantageous feature of the invention is that the recesses of the elements are each tapered for matingly received an associated ski and thus assuring a more secure fit between the elements and the skis.

Another advantageous feature of the present invention is that each of the elements has provided in the recess associated therewith a plurality of upstanding knock-out partitions which permit adjustment of the recess to skis of varying widths.

According to a preferred construction of a ski lock according to the invention, each of the clamp elements is provided with a groove arranged for receiving at least a portion of a ski pole. One preferred embodiment of the invention provides a groove in the bottom of the recesses for receiving a respective one of a pair of ski poles. By arrnaging these grooves at the same angle, generally an acute angle, relative to the, for example, hinge joining the elements, the poles will be oriented at an acute angle relative to the skis and to one another when the elements are in their clamping position. Alternatively, a pair of grooves may be formed in each of the clamp elements, with the grooves being disposed on either side of the recess of an associated element. In this manner, opposite grooves cooperate with one another to retain a single pole, with each pair of cooperating grooves being disposed at an acute angle with respect to one another to cause the poles to be crossed when the elements are in their clamping position. By this arrangement, the skis will be in a substantially parallel relationship facilitating insertion of the lower end, for example, of the skis into snow, and the like, while the poles will be crossed to prevent interference of the baskets provided on the poles with one another as well as affording stability to the upstanding skis.

A flexible member is preferably anchored to one of the elements at a predetermined point thereon, and is selectively attachable to and movable from at least one of the elements only when the elements are in a position other than the clamping position. Preferably, the flexible member is provided with an enlarged end portion, with the elements being provided with at least one indentation sized for receiving the enlarged portion and with a slot communicating with the indentation for receiving a portion of the flexible member adjacent the enlarged portion. By placing this indentation on the face of an element which abuts a like face on the other element when the elements are in the clamping position, it will be appreciated that the enlarged portion cannot be removed from the indentation when the elements are in their clamping position.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
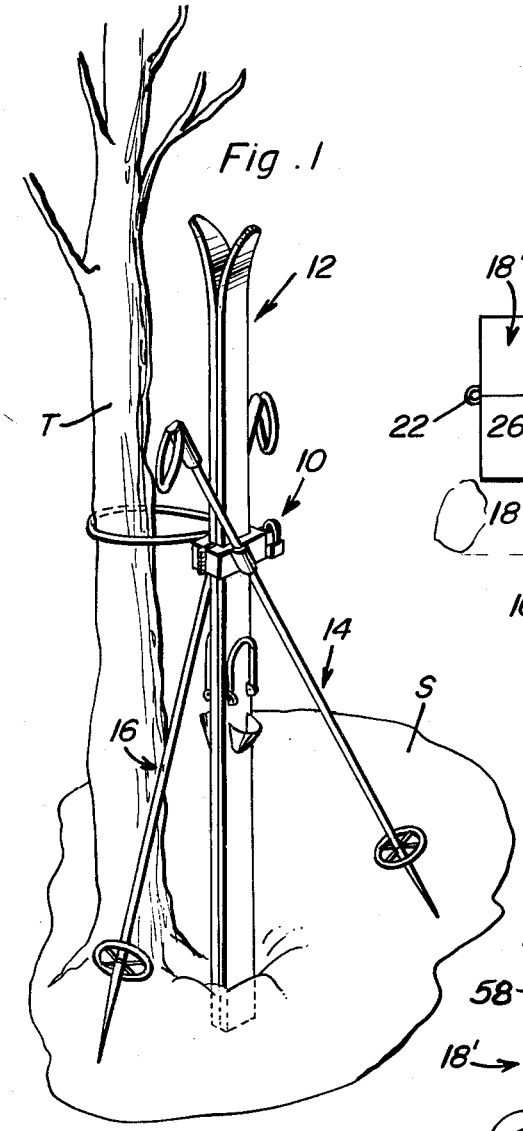
FIG. 1 is a perspective view showing a pair of skis and associated poles secured in an awkward package to handle by a ski lock according to the present invention, with the lock being fastened to a tree.

Referring now more particularly to FIG. 1 of the drawings, a lock 10 for skis according to the present invention is shown clampingly engaging a conventional pair of longitudinally extending skis 12 and their associated poles 14 and 16. From this figure, the relationship of the skis and poles can be seen, with the poles being crossed to avoid interference with one another, create an awkward package to handle, and to stable the upright skis in the snow S, and the like. Further, lock 10 is shown as attaching the skis 12 and poles 14 and 16, as well as itself, to a tree T, and the like. Thus, the practicality of a lock 10 according to the invention can be readily appreciated.

Figure 2:
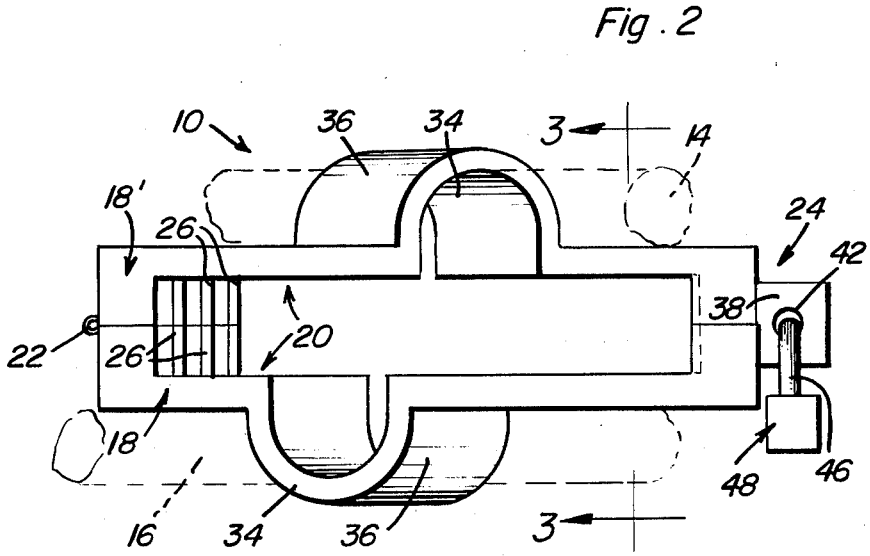
FIG. 2 is a top plan view showing a ski lock similar to that seen in FIG. 1.
Figure 3:
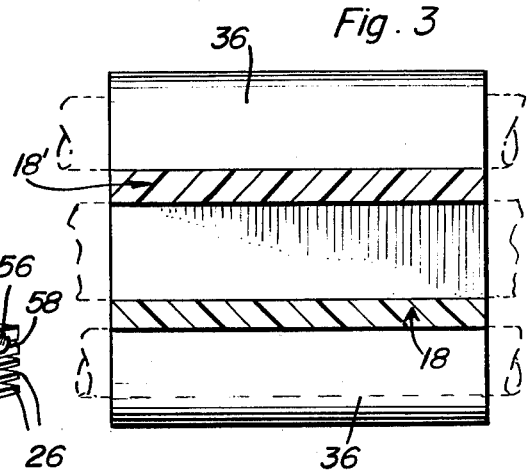
FIG. 3 is a sectional view taken generally along the line 3—3 of FIG. 2.
Figure 4:
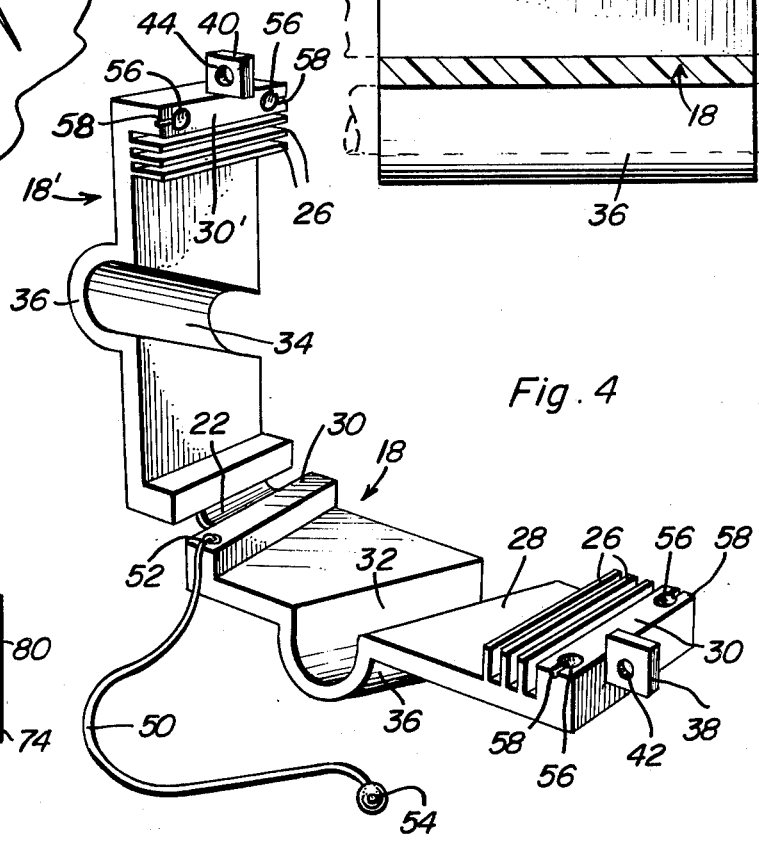
FIG. 4 is a perspective view showing the lock of FIGS. 2 and 3 in an open, ski and pole receiving position.

Referring now more particularly to FIGS. 2 through 4, lock 10 includes a pair of clamp elements 18 and 18' each provided with a recess 20 disposed for receiving a ski 12. A hinge 22 is connected to clamp elements 18, 18' for pivotally connecting together the elements 18, 18' and permitting relative movement between these elements to and from a clamping position, as shown in FIG. 2, wherein the skis 12 and poles 14 and 16 are securely retained. FIG. 4 shows an open position of the elements 18, 18' wherein the skis 12 and poles 14 and 16 may be inserted into lock 10.

A locking device 24 is advantageously connected to the elements 18, 18' for retaining the latter in abutting, ski-holding relationship forming the clamping position as seen in FIG. 2.

Advantageously, each recess 20 of elements 18, 18' is tapered from the bottom to the top thereof, or across the bottom of the associated recess 20, for assuring a good mating fit of a ski 12 in the recesses 20.

Each element 18, 18' is provided with at least one, and preferably a plurality of partitions 26 extending upwardly from the bottom surface 28 of a respective recess 20 so as to terminate in the clamping face 30 of the respective element 18, 18'. By selectively breaking off these partitions 26, a lock 10 can be adjusted to skis 12 of varying widths. For the purpose of facilitating removal of partitions 26, and in any event to minimize the weight of lock 10, elements 18, 18' are preferably constructed from a light weight material, such as a suitable synthetic resin. Since the material should also be of great strength, so as to prevent a would-be thief fom simply breaking open the lock 12, use of a material such as nylon is indicated. The partitions 26 could be removed from the recesses 20 as by use of a suitable saw, and the like.

Grooves 32 and 34 are arranged on elements 18 and 18', respectively, for receiving an associated longitudinally extending ski pole 14, 16. These grooves 32, 34 are disposed at acute angles of more than 0 degrees relative to the ski receiving recesses 20, the angles being taken along respective axes parellel to, or coaxial with, the longitudinal extent of skis 12 and poles 14, 16 received in lock 10, for orienting the poles 14, 16 at an acute angle relative to the skis and to one another by making the grooves parallel to one another when the elements 18 and 18' are disposed in a common plane. By this arrangement, the grooves 32, 34 will be at an acute angle, across one another, when the elements 18 and 18' are in their clamping, or FIG. 2, position. In the embodiment shown in FIGS. 2 through 4 of the drawings, the grooves are formed in the bottom surfaces 28 of the recesses 20 and are arranged to be opposite one another when the elements 18 and 18' are disposed in the clamping position. As mentioned above, the grooves are arranged so as to be at an acute angle with respect to one another when the elements 18, 18' are in the clamping position, and parallel to one another when the elements 18, 18' are in a fully open, or coplanar, position, which is not shown, but can be appreciated from FIG. 4. The grooves 32 and 34 are specifically constructed by bowed portions 36 of elements 18 and 18' which essentially interrupt the bottom surfaces 28 of the recesses 20 in mid-portions thereof.

The locking device 24 of lock 10 is illustrated as including a pair of projecting members 38 and 40 provided on elements 18 and 18', respectively, and provided with respective holes 42 and 44 which come into mating engagement when the elements 18, 18' are in clamping position. It will be appreciated that the members 38 and 40 are offset from one another from top to bottom of the lock 10 so as to permit these members 38, 40 to come into side-by-side relation when the lock 10 is closed. Thus arranged, the holes 42 and 44 can receive the shackle 46 of a conventional padlock 48 so that the elements 18 and 18' can be retained in their clamping position.

A flexible member 50, such as a length of light yet very strong steel wire, and the like, is anchored to one of the elements 18, 18' at a specified point thereon. As illustrated, member 50 is anchored to element 18 as by a conventional screw 52 at a point adjacent to hinge 22. The free end of member 50 is selectively attachable to at least one of the elements 18, 18' at a point spaced from the point of attachment of member 50 to element 18 so as to anchor the free end of member 50 to lock 10 only when the elements 18, 18' are in a position other than the clamping position. In the embodiment illustrated in FIGS. 2 through 4, flexible member 50 is provided with an enlarged end portion in the form of a ball 54. Further, both of the elements 18, 18' are shown as being provided with indentations 56 sized for receiving the ball 54, and with slots 58 arranged for receiving a portion of member 50 immediately adjacent ball 54 so as to permit good clamping contact between the clamping faces 30 and 30' of the elements 18 and 18'. By this arrangement, it will be appreciated that ball 54 can be inserted into and removed from an associated indentation 56 only when the elements 18 and 18' are in an open position such as shown in FIG. 4. When the elements 18 and 18' are in their clamping position as shown in FIGS. 2 and 3, ball 54 cannot be removed.

Figure 5:
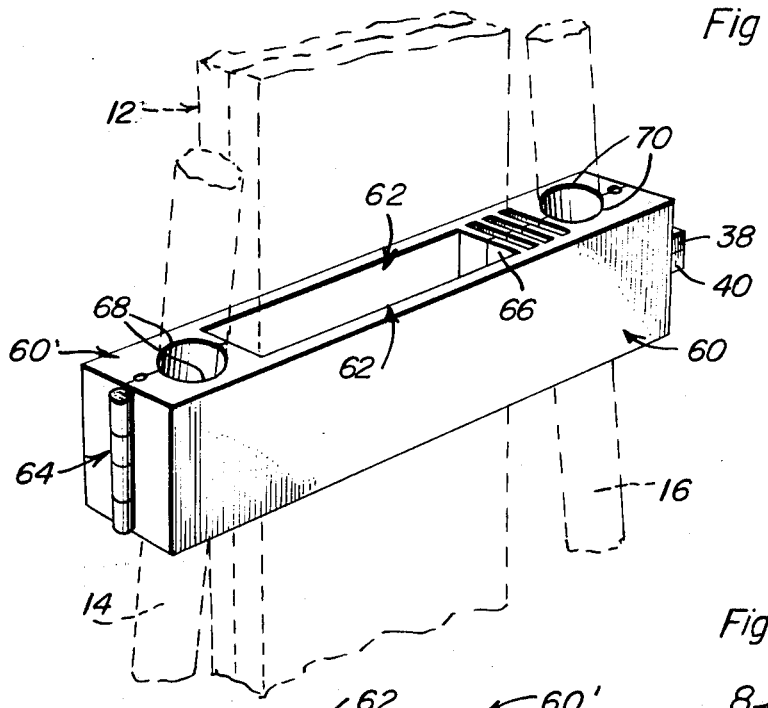
FIG. 5 is a perspective view showing a second embodiment of a ski lock according to the present invention.
Figure 6:
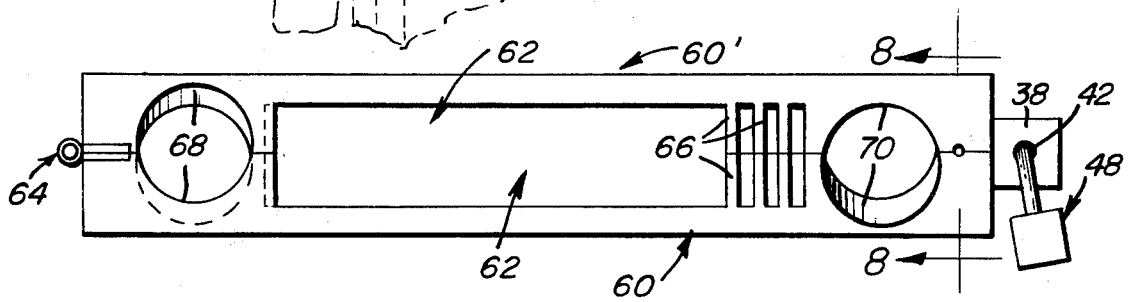
FIG. 6 is a top plan view showing a ski lock similar to that seen in FIG. 5.
Figure 7:
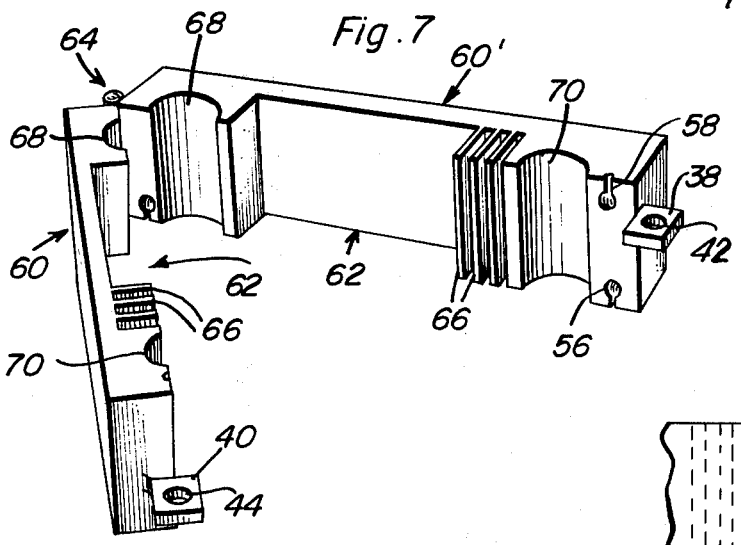
FIG. 7 is a perspective view showing the ski lock of FIG. 6 in an open, ski and pole receiving position.

FIGS. 5 through 7 of the drawings show a second embodiment of the invention wherein a pair of clamp elements 60 and 60' are each provided with a ski-receiving recess 62 similar to recess 20. A hinge 64 pivotally connects together the elements 60 and 60' from movement between a clamping position and various open positions. Disposed within each of the recesses 62 are at least one, and preferably a plurality of partitions 66 similar to partitions 26 in construction and function.

Grooves 68 and 70 are formed in elements 60 and 60' on either side of the respective recesses 62 thereof. By arranging respective grooves 68 and 70 to be opposite one another when the elements 60 and 60' are in a clamping position, such as shown in FIG. 6, ski poles 14 and 16 can be retained on each longitudinal side of the pair of skis 12. Further, the grooves 68 and 70 of each element 60, 60' are arranged at an acute angle with respect to one another so as to remain at such acute angle when the elements 60 and 60' are in their clamping position and the grooves 68 and 70, respectively, are paired with one another. In this manner, the ski poles 14 and 16 will be in crossed relationship, as can be seen from the broken line showing of the poles in FIG. 5.

Figure 8:
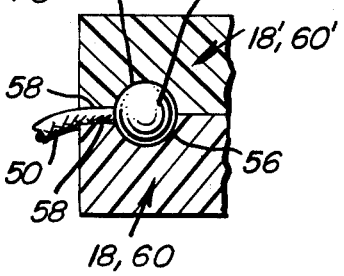
FIG. 8 is a fragmentary, sectional view taken generally along the line 8—8 of FIG. 6.

FIG. 8 is a detail showing the manner in which ball 54 attached to the free end of flexible member 50 rests in cooperating pairs of indentations 56 when a pair of clamp elements 18, 18' or 60, 60' are in their closed or clamping position. In particular, the manner in which the portion of member 50 immediately adjacent the ball 54 passes out from between the interface between the clamping elements by means of slots 58 is clearly shown. As will be appreciated, this manner of attachment of a flexible member 50 is equally applicable to the embodiment of the invention shown in FIGS. 5 through 7 as it is to the embodiment of FIGS. 2 through 4.

Figure 9:
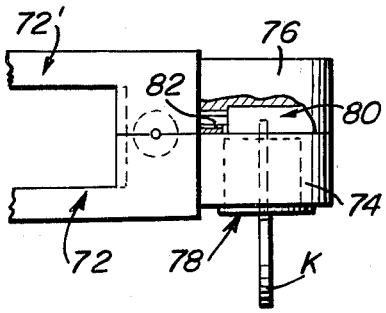
FIG. 9 is a fragmentary, top plan view showing a modified locking device for use with a lock according to the present invention.
Figure 10:
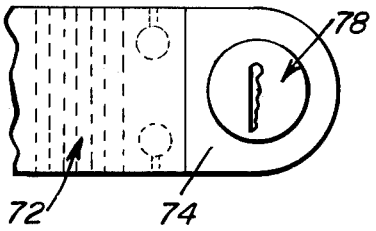
FIG. 10 is a fragmentary, side elevational view showing the modification of FIG. 9.

Referring now more particularly to FIGS. 9 and 10 of the drawings, a modified locking device according to the invention will now be described. As can be appreciated, this modified locking device can be shown with the embodiment set forth in FIGS. 2 through 4 and 5 through 7, although the clamping elements as seen in FIGS. 9 and 10 are designated by the reference numerals 72 and 72'. The latter mentioned elements are respectively provided with projecting portions 74 and 76 with portion 74 provided with a conventional lock cylinder 78 including a latch 80, and the portion 76 being at least partially hollow in order to receive latch 80 and having provided therein a keeper 82 which selectively retains latch 80 of cylinder 78 when cylinder 78 is turned as by a key K so as to lockingly secure elements 72 and 72' to one another.

As will be appreciated from the above description and from the drawings, a ski lock according to the present invention provides a simple, light weight, yet rugged and reliable device for attaching skis and their associated poles into an awkward package attachable to a fixed object such as a tree, rail, and the like, in order to prevent unscrupulous persons from taking the equipment. Further, two or more locks can be locked to each other.

The foregoing is considered as illustrative only of the principles of the invention. Further, since numerous modifications and changes will readily occur to those skilled in the art, it is not desired to limit the invention to the exact construction and operations shown and described, and accordingly all suitable modifications and equivalents may be resorted to, falling within the scope of the invention.

What we claim as new is as follows:

1. A lock for skis, comprising, in combination:

a. a pair of clamp elements each provided with a recess disposed for receiving a ski;

b. hinge means connected to the clamp elements for pivotally connecting together the elements and permitting relative movement between the elements to and from a position clampingly retaining a pair of skis and their associated poles;

c. locking means connected to the clamp elements for retaining the elements in abutting, ski-holding relationship forming the clamping position; and d. each element being provided with a plurality of planar knock-out partitions in the associated recess, the partitions standing upwardly in the recess toward the other of the elements when the elements are in the position clampingly retaining a pair of skis and extending in a plane parallel to a longitudinal extent of skis received in the lock for permitting adjustment of the lock to skis of various with widths by removal of selected ones of the partitions.

2. A lock for skis, comprising, in combinations:

a. a pair of clamp elements each provided with a recess disposed for receiving a ski;

b. hinge means connected to the clamp elements for pivotally connecting together the elements and permitting relative movement between the elements to and from a position clampingly retaining a pair of skis and their associated poles;

c. locking means connected to the clamp elements for retaining the elements in abutting, ski-holding relationship forming the clamping positions; and d. each of the clamp elements further including a groove arranged for receiving a ski pole, the grooves being disposed at acute angles of more than 0° relative to the ski receiving recesses, the angles being taken along respective axes parallel to a longitudinal extent of skis and poles received in the lock, for orienting the poles at an acute angle relative to the skis and to one another when the elements are in the clamping position.

3. A structure as defined in claim 2, wherein each recess of the elements is tapered for matingly receiving a ski.

4. A structure as defined in claim 2, wherein the grooves are formed in a bottom surface of the recesses and are arranged to be opposite one another when the elements are disposed in the clamping position, the grooves being at an acute angle with respect the axes of to one another when the elements are in the clamping position and parallel to one another when the elements are in a fully open, coplanar position.

5. A structure as defined in claim 2, wherein the locking means includes each of the elements being provided with a projecting member having a hole arranged for matching one another when the elements are in the clamping position and receiving the shackle of a padlock.

6. A structure as defined in claim 2, wherein the locking means includes each of the clamp elements being provided with a projecting portion, the projecting portion of one of the elements including a lock cylinder including a latch, and the projecting portion of the other of the elements having a hollow portion into which the latch extends when the clamp elements are in the closed position, and the other of the projecting portions having a keeper for retaining the latch of the lock cylinder when the lock cylinder is actuated to lockingly secure the clamp elements to one another.

7. A structure as defined in claim 2, wherein a flexible member having a pair of spaced ends is anchored to one of the elements at one of the ends and is selectively attachable to and removable from at least one of the elements at the other of the ends only when the elements are in a position other than the clamping position.

8. A lock for skis, comprising, in combination:

a. a pair of clamp elements each provided with a recess disposed for receiving a ski;

b. hinge means connected to the clamp elements for pivotally connecting together the elements and permitting relative movement between the elements to and from a position clampingly retaining a pair of skis and their associated poles; and c. locking means connected to the clamp elements for retaining the elements in abutting, ski-holding relationship forming the clamping position, each of the clamp elements further including a groove arranged for receiving a ski pole, the grooves being disposed at acute angles relative to the ski receiving recesses, the angles being taken along respective axes parallel to a longitudinal extent of skis and poles received in the lock, for orienting the poles at an acute angle relative to the skis and to one another when the elements are in the clamping position, the grooves being formed in the elements on either side of the respective recesses, opposite grooves cooperating to retain a single ski pole when the elements are in clamping position, the grooves of each of the elements being at the acute angle with respect to one another.

9. A lock for skis, comprising, in combination:

a. a pair of clamp elements each provided with a recess disposed for receiving a ski;

b. hinge means connected to the clamp elements for pivotally connecting together the elements and permitting relative movement between the elements to and from a position clampingly retaining a pair of skis and their associated poles;

c. locking means connected to the clamp elements for retaining the elements in abutting, ski-holding relationship forming the clamping position; and d. a flexible member having a pair of spaced ends is anchored to one of the elements at one of the ends and is selectively attachable to and removable from at least one of the elements at the other of the ends only when the elements are in a position other than the clamping position, the flexible member being provided with an enlarged end portion, with the elements being provided with at least one indentation sized for receiving the enlarged portion and a slot communicating with the indentation for receiving a portion of the flexible member adjacent the enlarged end portion.

10. A structure as defined in claim 9, wherein each recess of the elements is tapered for matingly receiving a ski.

11. A structure as defined in claim 10, wherein each element is provided with a plurality of knock-out partitions in the associated recess, the partitions standing upwardly in the recess for permitting adjustment of the lock to skis of various widths for removal of selected ones of the partitions.

12. A structure as defined in claim 11, wherein each of the clamp elements further includes a groove arranged for receiving a ski pole, the grooves being disposed at acute angles relative to the ski receiving recesses, the angles being taken along respective axes parallel to the longitudinal extent of skis and poles received in the lock, for orienting the poles at an acute angle relative to the skis and to one another when the elements are in the clamping position.

13. A structure as defined in claim 12, wherein the locking means includes each of the elements being provided with a projecting member having a hole arranged for matching one another when the elements are in the clamping position and receiving the shackle of a padlock.

14. A structure as defined in claim 12, wherein the locking means includes each of the clamp elements being provided with a projecting portion, the projecting portion of one of the elements including a lock cylinder including a latch, and the projecting portion of the other of the elements having a hollow portion into which the latch extends when the clamp elements are in the closed position, and the other of the projecting portions having a keeper for retaining the latch of the lock cylinder when the lock cylinder is actuated to lockingly secure the clamp elements to one another.

* * * * *